US007731381B2

(12) United States Patent
Littau et al.

(10) Patent No.: US 7,731,381 B2
(45) Date of Patent: Jun. 8, 2010

(54) LIGHTING DEVICE FOR A HOUSEHOLD APPLIANCE HAVING A TREATMENT CHAMBER

(75) Inventors: Friedrich Littau, Delbrueck-Boke (DE); August Oberroehrmann, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 250 days.

(21) Appl. No.: 11/940,537

(22) Filed: Nov. 15, 2007

(65) Prior Publication Data

US 2008/0123325 A1 May 29, 2008

(30) Foreign Application Priority Data

Nov. 16, 2006 (DE) ..... 10 2006 054 456

(51) Int. Cl.
*A47F 11/10* (2006.01)
*F27D 21/02* (2006.01)
*F25D 23/02* (2006.01)

(52) U.S. Cl. ..... 362/125; 362/290; 362/296.9; 362/297

(58) Field of Classification Search ..... 362/92, 362/125, 126, 28, 26, 560, 576, 511, 290, 362/293, 310, 296.01, 297, 301, 296.9
See application file for complete search history.

(56) References Cited

U.S. PATENT DOCUMENTS

| | | | | |
|---|---|---|---|---|
| 2,253,933 | A * | 8/1941 | Hall | 362/284 |
| 3,079,529 | A * | 2/1963 | Novinger | 362/282 |
| 3,586,851 | A * | 6/1971 | Rudolph | 362/293 |
| 3,984,673 | A * | 10/1976 | Gray | 362/293 |
| 4,872,098 | A * | 10/1989 | Romano | 362/283 |
| 4,914,553 | A * | 4/1990 | Hamada et al. | 362/560 |
| 5,054,885 | A * | 10/1991 | Melby | 359/618 |
| 6,200,006 | B1 * | 3/2001 | Natsume et al. | 362/297 |
| 6,305,813 | B1 * | 10/2001 | Lekson et al. | 362/625 |
| 6,502,950 | B2 * | 1/2003 | Signer | 362/147 |
| 6,637,923 | B2 * | 10/2003 | Amano | 362/545 |
| 7,157,667 | B2 | 1/2007 | Gramlich et al. | |
| 7,484,864 | B2 * | 2/2009 | Okada | 362/300 |
| 2004/0264168 | A1 * | 12/2004 | Gotz et al. | 362/92 |

(Continued)

FOREIGN PATENT DOCUMENTS

| | | |
|---|---|---|
| DE | 8602774 | 3/1986 |

(Continued)

*Primary Examiner*—Ismael Negron
(74) *Attorney, Agent, or Firm*—Leydig, Voit & Mayer, Ltd.

(57) ABSTRACT

A lighting device includes a light channel disposed in a wall or door of a treatment chamber. A light source cooperating with the light channel is disposed outside of the treatment chamber and provides light beams along a first direction. First and second reflectors are disposed in the light channel to reflect respective portions of the light beams toward the treatment chamber so as to enter the treatment chamber through a transparent area in the wall or door. The second reflector extends further in a second direction, which is transverse to the first direction, than the first reflector, such that the second portion of the light beams reaches the second reflector in an unhindered manner. The first and second reflectors have reflective surfaces thereon which are configured differently in the second direction and a third direction transverse to the first direction in order to prevent mutual shadowing.

11 Claims, 2 Drawing Sheets

U.S. PATENT DOCUMENTS

2006/0266347 A1 11/2006 Gramlich et al.

FOREIGN PATENT DOCUMENTS

| | | | |
|---|---|---|---|
| DE | 8609316 | | 6/1986 |
| DE | 4215968 | A1 | 12/1993 |
| DE | 10318859 | | 11/2004 |
| DE | 10318860 | | 11/2004 |
| DE | 10318861 | | 11/2004 |
| EP | 0446692 | | 9/1991 |
| EP | 922910 | | 6/1999 |
| FR | 2826707 | | 1/2003 |
| GB | 2416202 | | 1/2006 |
| WO | 03036176 | | 5/2003 |

* cited by examiner

LIGHTING DEVICE FOR A HOUSEHOLD APPLIANCE HAVING A TREATMENT CHAMBER

CROSS REFERENCE TO RELATED APPLICATIONS

Priority is claimed to German patent application DE 10 2006 054 456.0, filed Nov. 16, 2006, and which is hereby incorporated by reference herein.

FIELD OF THE INVENTION

The present invention relates to a lighting device for a household appliance having a treatment chamber.

BACKGROUND

A lighting device for a household appliance, in this case, for example, for a baking oven or a refrigerator, is described in German Utility model G 86 02 774.3, where light source is provided which is disposed on the side wall and separated from the treatment chamber by a glass pane. The light source is surrounded by a reflector means to direct the light beams into the treatment chamber. A similar such device is described for a baking oven German Utility model G 86 09 316.9. In this variant, the light sources are disposed above the treatment chamber, and the light beams are radiated into the treatment chamber through so-called "light-guiding channels". European Patent Publication EP 0 446 692 describes a further lighting device which is for use in a refrigerator and is provided with a tubular light guide. In that approach, the light radiation is introduced into the refrigeration compartment through a rod-shaped light carrier made of glass or plastic into the treatment chamber, the light source being mounted outside of the treatment chamber.

Another lighting device for the treatment chamber of a household appliance is described in European Patent Publication EP 0 922 910. The embodiment disclosed therein has so-called "light channels" which are disposed on the side walls of the treatment chamber and allow introduction of light beams from a light source located in the upper portion of the treatment chamber. The light beams are deflected toward the treatment chamber by reflection means disposed one above the other in the light channel, thus illuminating different levels in the treatment chamber.

German Patent Publications DE 103 18 860, DE 103 18 859 and DE 103 18 861 also describe a similar lighting device for a cooking appliance. The embodiment described therein is also provided with reflection means which are disposed at different levels in channels in the region of the door and which allow light beams to be reflected at different levels. The light channel is designed such that the extent of the reflection means, at least in one direction transverse to the light beams emitted by the light source toward the reflection means, increases with increasing distance of the respective reflection means from the light source and in such a manner that part of the light beams reach the more distal reflection means in an unhindered manner.

These lighting devices have the problem that they do not provide for optimum illumination of the treatment chamber, especially as the amount of light radiation introduced is not optimally used. Another reason for this is that these lighting devices for household appliances only use special light sources of low efficiency.

SUMMARY

Therefore, an aspect of the present invention is to provide a lighting device including a light channel for a household appliance having a treatment chamber in such a manner that the efficiency of lighting in the treatment chamber is improved.

In an embodiment, the present invention provides a lighting device for a household appliance with a treatment chamber. The lighting device includes at least one light channel disposed in a wall of the treatment chamber or a door of the treatment chamber. A light source cooperating with the at least one light channel is disposed on the household appliance outside of the treatment chamber and provides light beams along a first direction. A first reflector is disposed in the light channel to reflect a first portion of the light beams toward the treatment chamber so as to enter the treatment chamber through a transparent area in the wall or door. A second reflector is disposed in the channel at a position further from the light source than the first reflector. The second reflector reflects a second portion of the light beams toward the treatment chamber so as to enter the treatment chamber through the transparent area. The second reflector extends further in a second direction, which is transverse to the first direction, than the first reflector, such that the second portion of the light beams reaches the second reflector in an unhindered manner. The first and second reflectors have first and second reflective surfaces thereon which are configured differently in the second direction and a third direction transverse to the first direction, in order to prevent mutual shadowing.

BRIEF DESCRIPTION OF THE DRAWINGS

An exemplary embodiment of the present invention is shown schematically in the drawings and will be described in more detail below, with reference to the drawings in which.

The lighting device of the present invention is provided with individual reflectors which are disposed in the light channel and which, in terms of their extent in the two main directions of extension of a plane transverse to the direction of emission of the light beams, are configured differently such that mutual shadowing of the reflector surfaces is prevented. Due to this design, reflection of radiation toward the treatment chamber at different depth levels of treatment chamber is achieved. To this end, the individual reflectors in the light channel include reflective surfaces whose reflective areas are configured differently such that mutual shadowing of the reflector surfaces is prevented. In an embodiment, the strip-shaped reflective surfaces are each arranged in the light channel in such a manner that they are at an angle of 45° to the direction of emission of the light beams.

The individual strip-shaped reflectors can have cutouts along its length, so that light beams introduced from above the treatment chamber can pass unhindered to lower reflector surfaces, and sufficient light efficiency is provided on the lower reflector surfaces.

In an embodiment, the light source is surrounded by a parabolic reflector housing. Furthermore, it is possible to use standard light sources, such as fluorescent tubes, which have a significantly higher efficiency. These extend along the direction of the strip-shaped reflector surfaces. The parabolic reflector housing is mounted on the light channel via a thermal insulating means, said insulating means preferably being a glass pane. Advantageously, a flat glass pane is mounted in at least one of the side walls of the treatment chamber or in the treatment chamber door, said flat glass pane forming the side wall of the flat light channel. This design enables the lighting device to act across substantially the entire surface of the wall because, as explained earlier, the extent of the individual reflection means covers the two main directions of extension in a plane transverse to the direction of emission of the light beams. Because of this, a lighting device can be provided which allows for large surface radiation, and which, in particular, allows the light channel to be made very narrow because of the different configurations of the reflector surfaces.

Figure 1:
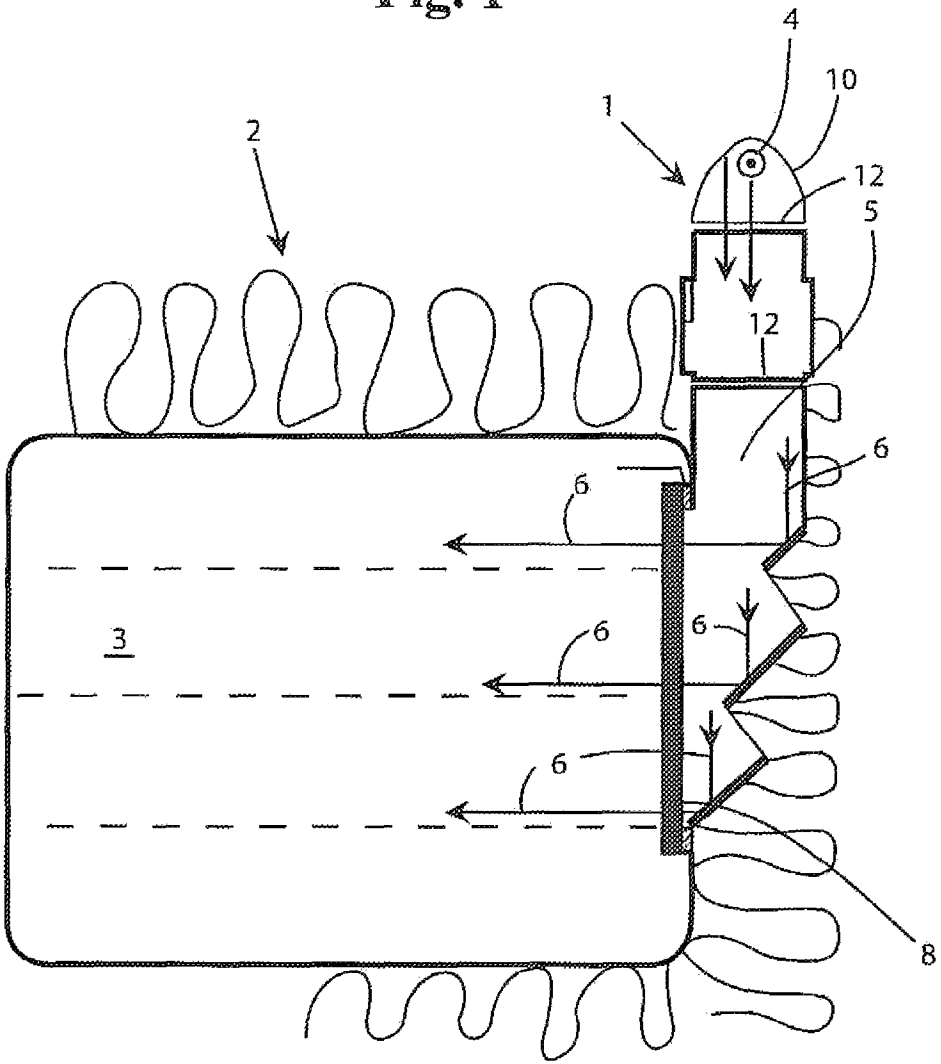
FIG. 1 is a cross-sectional front view of a treatment chamber having an integrated lighting device.

FIG. 1 shows, in a sectional view, a lighting device 1 for a household appliance 2 having a treatment chamber 3, which here may take the form of an oven chamber or a refrigeration compartment. Lighting device 1 includes at least one light source 4, which is mounted on household device 2 at a location outside of treatment chamber 3. As can be seen in the cross-sectional view of FIG. 1, light source 4 cooperates with a light channel 5 which is disposed on one of the walls of treatment chamber 3 or on a treatment chamber door (not shown). As is shown in the figure, in order to illuminate treatment chamber 3, light beams 6 are produced by light source 4 and deflected toward treatment chamber 3 by reflectors 7.1, 7.2 and 7.3 disposed in light channel 5. In the process, light beams 6 enter treatment chamber 3 through a transparent glass pane 8 mounted in the wall or in the treatment chamber door.

Figure 2:
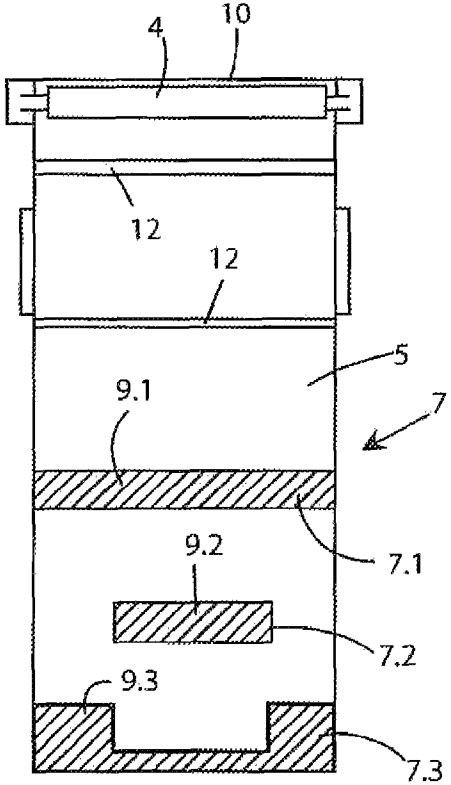
FIG. 2 is an isolated front view of the lighting device.

As can be seen from FIG. 1, the extent of reflectors 7.1 to 7.3 in a direction transverse to the light beams 6 emitted by light source 4 toward reflectors 7.1 to 7.3 increases with increasing distance of the respective reflectors 7.1 to 7.3 from light source 4 and in such a manner that part of the light beams 6 reach the more distal reflectors 7.2 or 7.3 in an unhindered manner. Especially when considering FIGS. 1 and 2 together, it becomes clear that the individual reflector 7.1 to 7.3 is enlarged in size in terms of its extent in the two main directions of extension of a plane transverse to the direction of emission of light beams 6.

The individual reflectors in light channel 5, include strip-shaped reflector surfaces 9.1, 9.2 and 9.3. The reflective areas of strip-shaped reflector surfaces 9.1 to 9.3 are configured differently so as to prevent mutual shadowing of reflector surfaces 9.1 to 9.3, which may be caused by incident light beams 6. Thus, it becomes clear that in FIG. 2, surfaces 9.1 to 9.3 are directly hit by light beams 6, which are then suitably deflected and transmitted into treatment chamber 3. It becomes clear that especially also the lower reflection surface 9.3 has sufficient light output efficiency along its width because light beams 6 can still act in the two main directions of extension transverse to the direction of emission of light beams 6.

As can be seen in FIG. 1, the individual strip-shaped reflector surfaces 9.1, 9.2 and 9.3 are preferably arranged in light channel 5 in such a manner that they are at an angle of 45° to the direction of emission of the light beams 6. As has been described earlier, the individual strip-shaped reflector surface 9.1, 9.2 or 9.3 has cutouts along its length, as is the case, for example, with reflector surface 9.2.

Referring to the integration of light source 4, it will be seen that light source 4 is surrounded by a parabolic reflector housing 10. A light source 4 in the form of a fluorescent tube can be provided in parabolic reflector housing 10, as can be seen particularly well in FIG. 2. When considering FIGS. 1 and 2 together, it can be seen that parabolic reflector housing 10 is mounted on light channel 5 via a thermal insulating means 12. This insulating means is a glass pane 12. As can be seen in FIG. 1, and also when considering FIGS. 1 and 2 together, a flat glass pane 8 forms a side wall of flat light channel 5 in at least one of the side walls of treatment chamber 3 or in a treatment chamber door (not shown).

Figure 3:
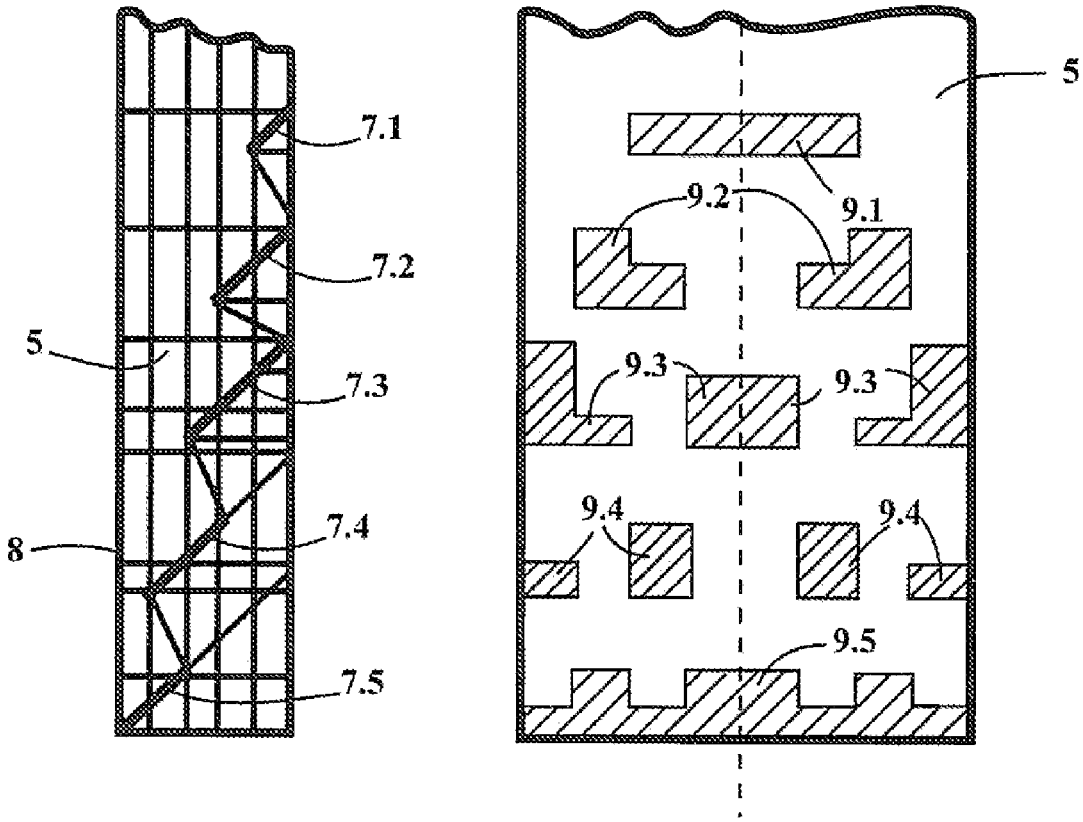
FIG. 3 is an isolated view showing the reflection means in a front view and in a corresponding side view.

FIG. 3 illustrates another embodiment of the reflectors 7.1 to 7.5 according to the present invention. Here, reflectors 7.1 to 7.5 have reflective surfaces 9.1, 9.2, 9.3, 9.4 and 9.5. In this variant of the reflective surfaces 9.1 to 9.5, it becomes clear that, due to the configuration of the different reflector surfaces in the two main directions of extension transverse to the direction of emission of light beams 6, sufficient light efficiency is achieved also on lowermost reflective surface 9.5. Here, too, the individual strip-shaped reflective surfaces 9.1 to 9.5 are preferably arranged in light channel 5 in such a manner that they are at an angle of 45° to the direction of emission of the light beams 6, the individual strip-shaped reflective surfaces 9.1 to 9.5 also having cutouts along their lengths, which provide, in particular, that sufficient light efficiency can be provided for treatment chamber 3 also on the lower reflective surfaces 9.2 to 9.5.

What is claimed is:

1. A lighting device for a household appliance with a treatment chamber, the lighting device comprising:

at least one light channel disposed in a wall of the treatment chamber or a door of the treatment chamber;

at least one light source disposed on the household appliance outside of the treatment chamber, the light source cooperating with the at least one light channel and operable to provide light beams along a first direction;

a first reflector disposed in the at least one light channel operable to reflect a first portion of the light beams toward the treatment chamber so as to enter the treatment chamber through a transparent area in the wall or door of the treatment chamber, a second reflector disposed in the at least one light channel operable to reflect a second portion of the light beams toward the treatment chamber so as to enter the treatment chamber through the transparent area, the second reflector being further from the light source in the first direction and extending farther in a second direction transverse to the first direction, than the first reflector, such that the second portion of the light beams reach the second reflector in an unhindered manner;

a first reflective surface disposed on the first reflector and having a configuration in the second direction and a third direction transverse to the first direction; and a second reflective surface disposed on the second reflector, the second reflective surface having a configuration in the second direction and the third direction, the configuration of the second reflective surface being different from the configuration of the first reflective surface in both the second and third directions so as to avoid shadowing of the second reflective surface by the first reflective surface.

2. The lighting device as recited in claim 1, wherein at least one of the reflective surfaces includes a cutout along a length thereof.

3. The lighting device as recited in claim 1, wherein the at least one light source includes a fluorescent tube.

4. The lighting device as recited in claim 1 further comprising a flat glass pane disposed in the wall or door of the treatment chamber so as to form a sidewall of the light channel.

5. The lighting device as recited in claim 1 further comprising:

a third reflector disposed in the at least one light channel operable to reflect a third portion of the light beams toward the treatment chamber through the transparent area, the third reflector being further from the light source in the first direction than the second reflector and extending further in the second direction than the second reflector, such that the third portion of the light beams reach the third reflector in an unhindered manner; and a third reflective surface disposed on the third reflector, the third reflective surface being configured differently in the second direction and third direction than the first reflective surface and second reflective surface so as to avoid shadowing from the first and second reflective surfaces.

6. The lighting device as recited in claim 1, wherein the reflective surfaces are strip-shaped.

7. The lighting device as recited in claim 6, wherein the strip-shaped reflective surfaces are each disposed in the light channel at an angle of 45.degree. to the first direction.

8. The lighting device as recited in claim 1, further comprising a parabolic reflector housing surrounding the at least one light source.

9. The lighting device as recited in claim 8, wherein the light source includes a fluorescent tube.

10. A lighting device for a household appliance with a treatment chamber, the lighting device comprising:

at least one light channel disposed in a wall of the treatment chamber or a door of the treatment chamber;

at least one light source including a fluorescent tube disposed on the household appliance outside of the treatment chamber, the light source cooperating with the at least one light channel and operable to provide light beams along a first direction;

a first reflector disposed in the at least one light channel operable to reflect a first portion of the light beams toward the treatment chamber so as to enter the treatment chamber through a transparent area in the wall or door of the treatment chamber, a second reflector disposed in the at least one light channel operable to reflect a second portion of the light beams toward the treatment chamber so as to enter the treatment chamber through the transparent area, the second reflector being further from the light source in the first direction and extending farther in a second direction transverse to the first direction, than the first reflector, such that the second portion of the light beams reach the second reflector in an unhindered manner;

a first reflective surface disposed on the first reflector;

a second reflective surface disposed on the second reflector, the second reflective surface being configured differently, in the second direction and a third direction transverse to the first direction, than the first reflective surface so as to avoid mutual shadowing of the reflective surfaces;

a parabolic reflector housing surrounding the at least one light source; and a thermal insulator disposed between the parabolic reflector housing and the at least one light channel.

11. The lighting device as recited in claim 10, wherein the thermal insulator includes a glass pane.

* * * * *